US011629904B1

(12) United States Patent
Chen et al.

(10) Patent No.: US 11,629,904 B1
(45) Date of Patent: Apr. 18, 2023

(54) ADJUSTABLE REFRIGERATOR SHELVING

(71) Applicant: BBY Solutions, Inc., Richfield, MN (US)

(72) Inventors: Weichao Chen, Shenzhen (CN); Kaixuan He, Shenzhen (CN)

(73) Assignee: BBY Solutions, Inc., Richfield, MN (US)

( * ) Notice: Subject to any disclaimer, the term of this patent is extended or adjusted under 35 U.S.C. 154(b) by 0 days.

(21) Appl. No.: 17/573,799

(22) Filed: Jan. 12, 2022

(51) Int. Cl.

| | |
|---|---|
| ***F25D 23/04*** | (2006.01) |
| ***F25D 23/02*** | (2006.01) |
| ***F25D 25/02*** | (2006.01) |
| ***A47B 96/16*** | (2006.01) |
| ***A47B 57/06*** | (2006.01) |

(52) U.S. Cl.
CPC ..... *F25D 23/028* (2013.01); *A47B 57/06* (2013.01); *A47B 96/16* (2013.01); *F25D 23/04* (2013.01); *F25D 25/02* (2013.01)

(58) Field of Classification Search
CPC ..... F25D 23/028; F25D 25/02; F25D 23/04; F25D 25/04; F25D 25/024; F25D 23/067; F25D 2323/02; F25D 2325/021; A47B 57/06; A47B 57/30; A47B 57/48; A47B 57/482; A47B 96/16; A47B 2210/17; A47B 57/34
See application file for complete search history.

(56) References Cited

U.S. PATENT DOCUMENTS

| | | | | |
|---|---|---|---|---|
| 3,885,846 | A * | 5/1975 | Chuang | F25D 25/02 211/187 |
| 5,160,191 | A | 11/1992 | Holland | |
| 5,226,717 | A | 7/1993 | Hoffman | |
| 6,062,780 | A * | 5/2000 | Petelka | B60P 7/15 410/150 |
| 6,074,143 | A * | 6/2000 | Langston | B60P 1/00 410/148 |
| 8,562,089 | B2 | 10/2013 | Collins | |
| 10,544,984 | B2 * | 1/2020 | Park | F25D 25/022 |
| 2012/0018435 | A1 * | 1/2012 | Kim | F25D 23/04 220/592.02 |
| 2012/0293056 | A1 * | 11/2012 | Kim | F25D 23/04 312/405.1 |
| 2014/0042886 | A1 * | 2/2014 | Baldo | F25D 23/028 312/405.1 |
| 2014/0062283 | A1 * | 3/2014 | Baldo | F16M 13/022 312/405.1 |
| 2022/0018593 | A1 * | 1/2022 | Scalf | F25D 25/005 |
| 2022/0074646 | A1 * | 3/2022 | Jin | A47B 57/34 |

* cited by examiner

*Primary Examiner* — Hiwot E Tefera
(74) *Attorney, Agent, or Firm* — Forsgren Fisher; James M. Urzedowski; Daniel A. Tysver

(57) ABSTRACT

Embodiments disclosed herein are directed to a shelf and shelving system for a refrigerator door having a door liner with opposing side walls, where each side wall includes a row of ditch steps. The shelf or shelves includes a gap wall at each end of the shelf. A switch is positioned above each gap wall. Each switch includes a handle, a mounting rod and a biasing member for biasing a long component of the handle outwardly away from the gap wall such that an engagement surface of the long component will engage a ditch step and thereby secure the shelf in place within the refrigerator door. The switch is actuatable by a user to allow for vertical adjustment of the shelf along the rows of ditch steps or to remove the shelf therefrom.

9 Claims, 15 Drawing Sheets

ADJUSTABLE REFRIGERATOR SHELVING

FIELD OF THE INVENTION

Embodiments disclosed herein relate to appliances having integrated door shelving such as a refrigerator, freezer, etc. and to providing such door shelving with individual shelves whose vertical (height) spacing is readily adjustable.

BACKGROUND OF THE INVENTION

The present invention generally relates to refrigerators and, more specifically to vertically adjustable storage shelving positioned within the interior of the refrigerator's doors.

A typical refrigeration appliance, such as a refrigerator/freezer, includes doors having a plastic or metal liner or insert to which one or more storage shelves may be secured thereto. Often the liner will include opposing support grooves or notches that can receive and support shelves at various set positions along the height of the door. The relative height of the shelves may be adjusted by removing a shelf from one set of support grooves and replacing it into the support grooves corresponding to the new position.

Most refrigerators provide only a few support grooves along the height of the door, which limits the relative position of multiple shelves from one another. Once installed and in use, adjusting the spacing/relative height of the shelves is burdensome to the user, as the fully loaded shelf will likely need to be emptied, then removed from the door, repositioned, and then reloaded. During such a prolonged process the door to the refrigerator must be left open, which is inherently inefficient to the operation of the refrigerator and detrimental to its contents.

Accordingly, there is a need in the art for an adjustable shelving system that provides shelves that are quick and easy to adjust even when the shelf being adjusted is fully loaded, and provides a greater degree of adjustability within the confines of the door's height.

SUMMARY OF THE INVENTION

Embodiments of the adjustable refrigerator shelving described herein utilize a unique refrigerator door interior that includes opposing sides that define a row of ditch steps along all or some portion of their height. One or more shelves have opposed switches that are received into the ditch steps. Each switch is biased in an outward direction from the shelf so as to engage the ditch steps and thereby secure the shelf in place. A secured shelf may be adjusted vertically upward by applying an upward force to the shelf. This force will overcome the outward bias of the switches, causing them to pivot toward the shelf, temporarily disengaging the switches from the current opposing ditch steps. As the shelf is moved upward, the switches will automatically snap back outward to engage the next higher placed ditch steps. Each switch has a grasping surface or edge which a user may press to disengage the switch from its current the ditch step to allow for vertical downward adjustability of the shelf.

By providing the door with opposed rows of ditch steps and each shelf with a pair to switches to engage ditch steps the adjustable refrigerator shelving described herein provides a refrigeration appliance with shelves whose vertical position along the door is easily and quickly adjusted, even when fully loaded and in use.

Exemplary embodiments of the adjustable refrigerator shelving is shown in the following drawings and described in detail below.

DETAILED DESCRIPTION

Figure 1:
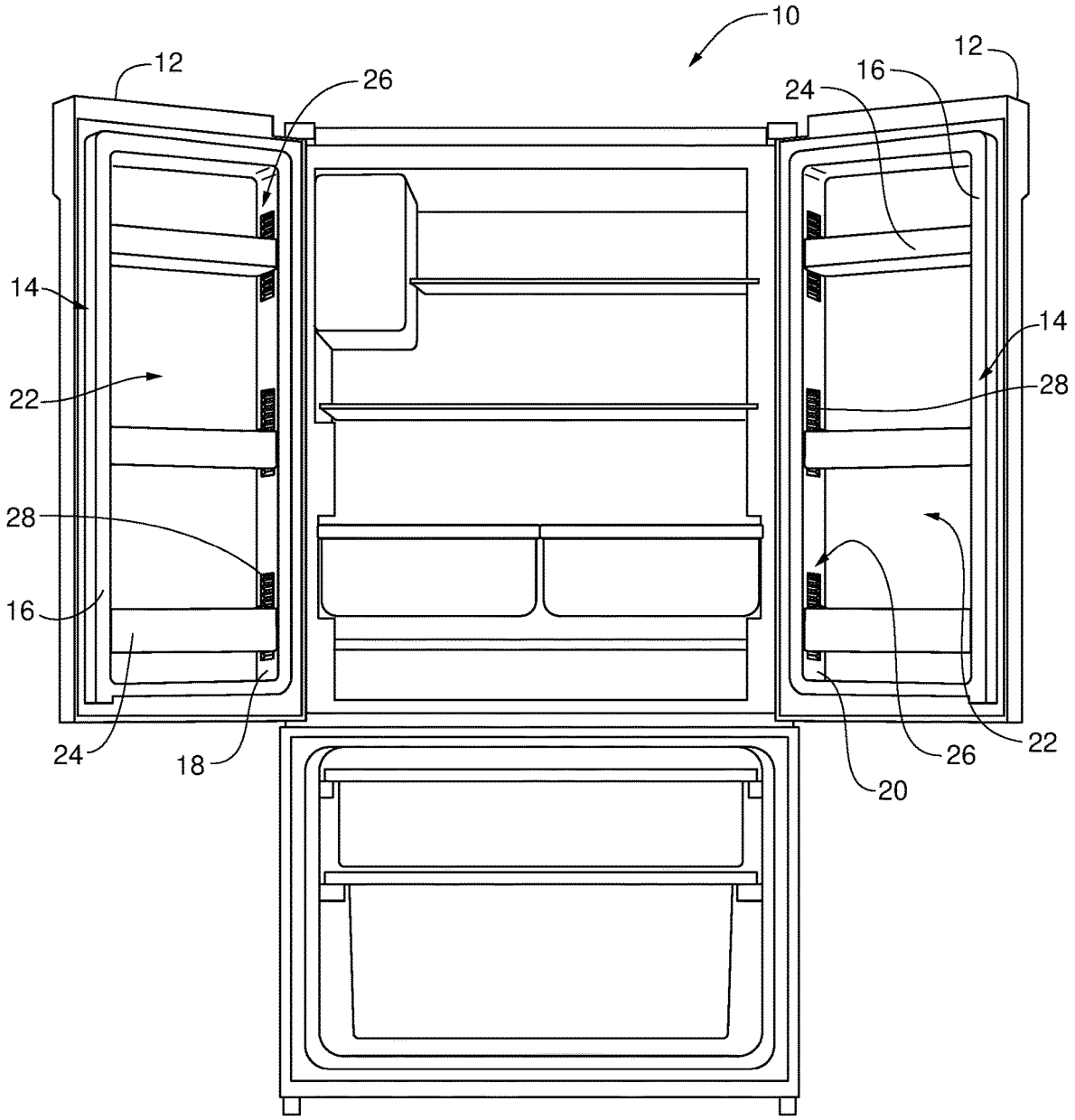
FIG. 1, is a front view of a refrigerator having doors that incorporate an embodiment of the adjustable refrigerator shelving system, wherein the rows of ditch steps provided in each door are segmented.
Figure 2:
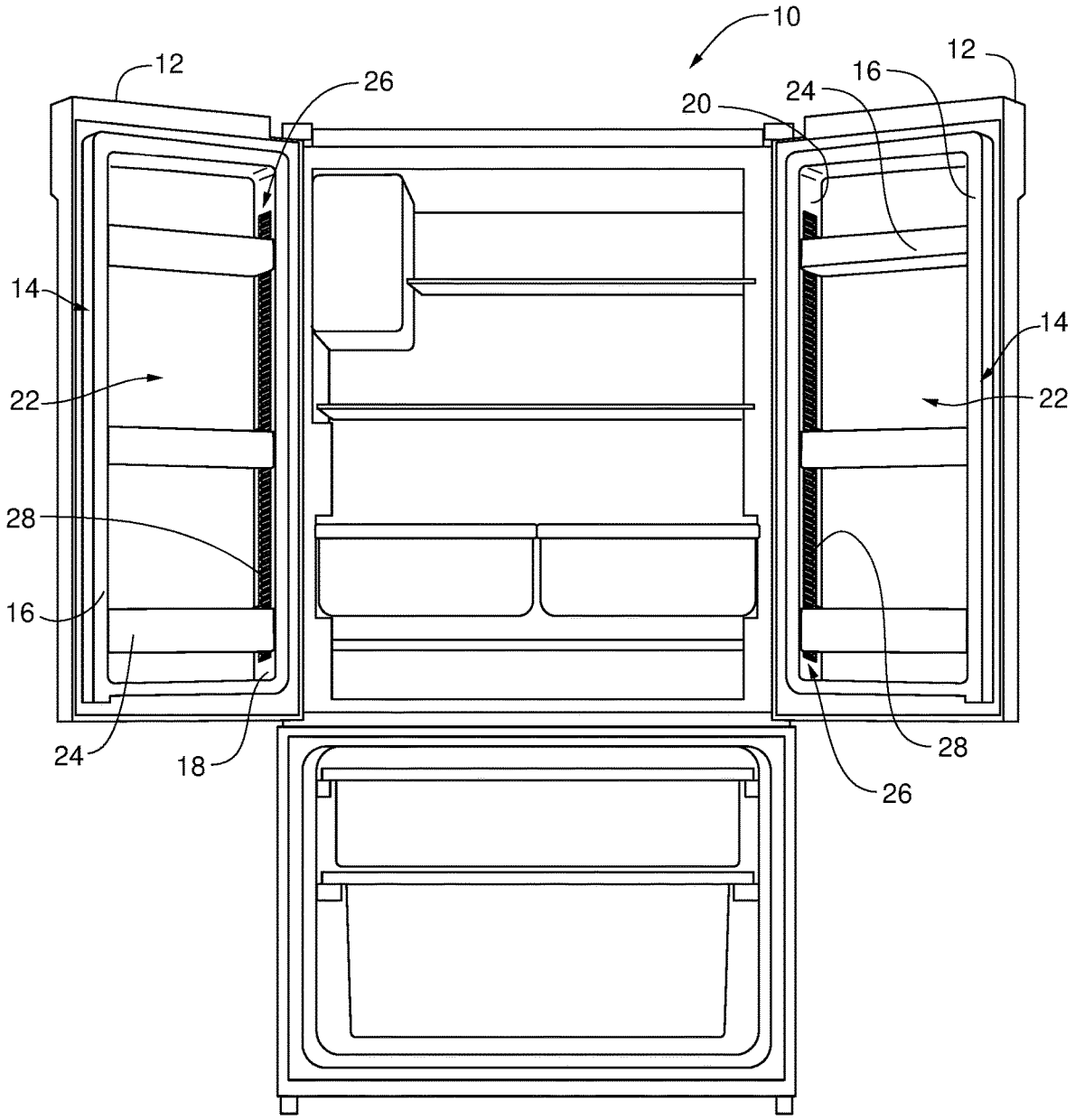
FIG. 2, is a front view of the refrigerator shown in FIG. 1 wherein the rows of ditch steps are uninterrupted.

In FIGS. 1 and 2 a refrigerator 10 is shown with doors 12 that incorporate an embodiment of the adjustable shelving system 14. System 14 includes a door insert or liner 16, having opposing side walls 18 and 20 which define the door interior 22 into which a shelf or shelves 24 may be inserted. To secure the shelf 24 within the interior 22, each of the opposing side walls 18 and 20 define a row 26 of ditch steps 28.

Figure 3:
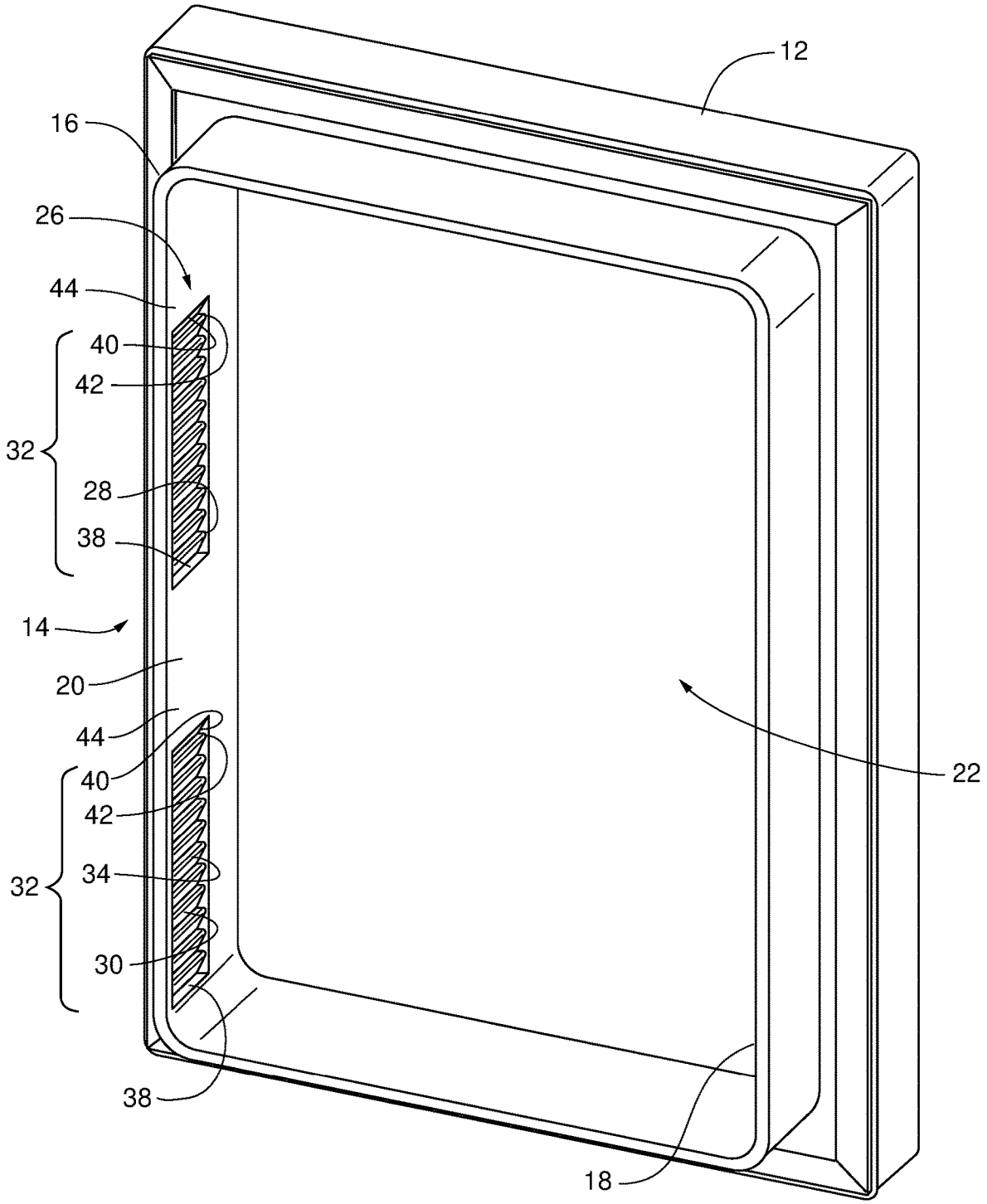
FIGS. 3 and 4, are close-up, opposing, front perspective views of a refrigerator door showing the segmented rows of ditch steps on the opposing side walls of the door.
Figure 4:
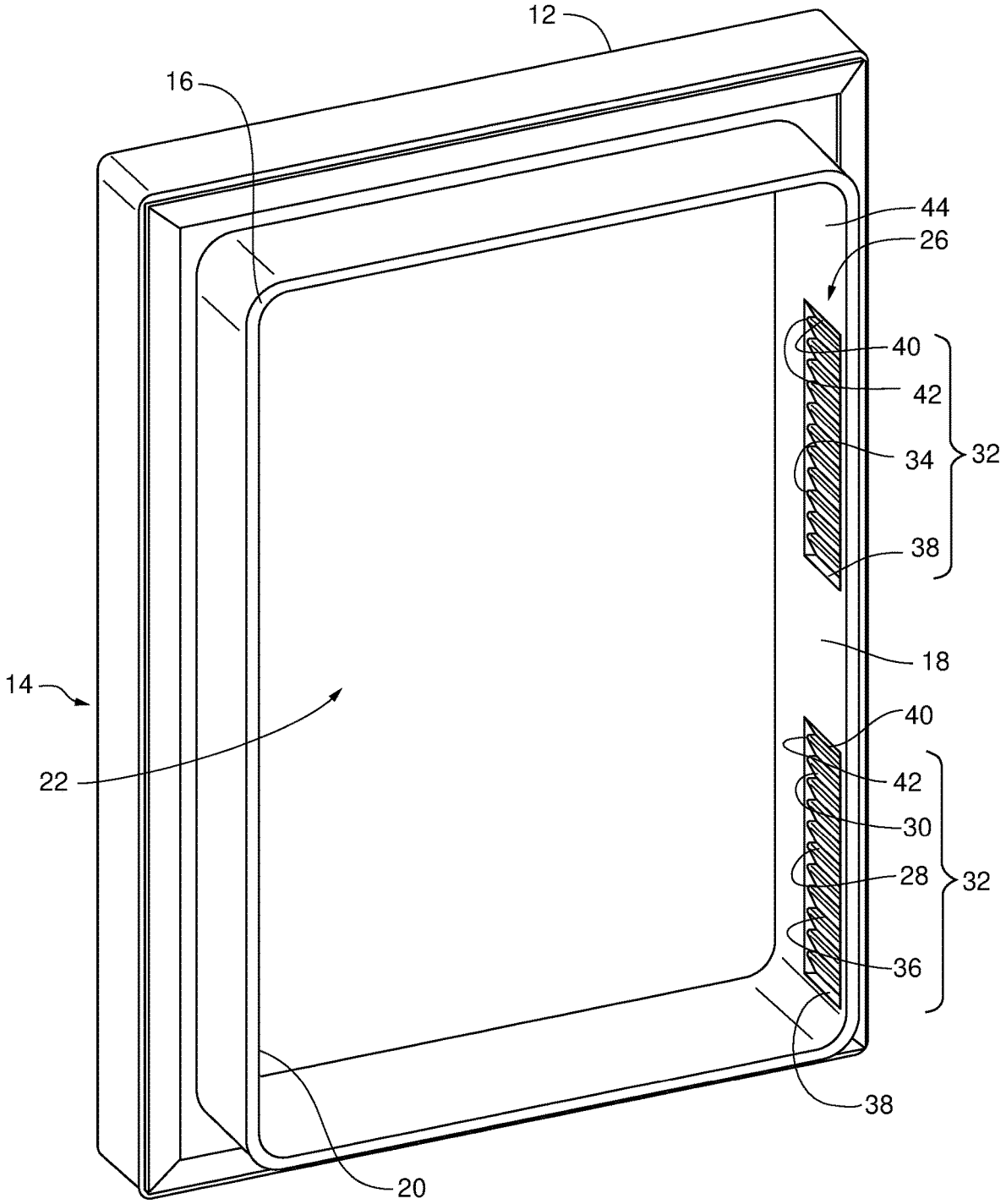
Figure 5:
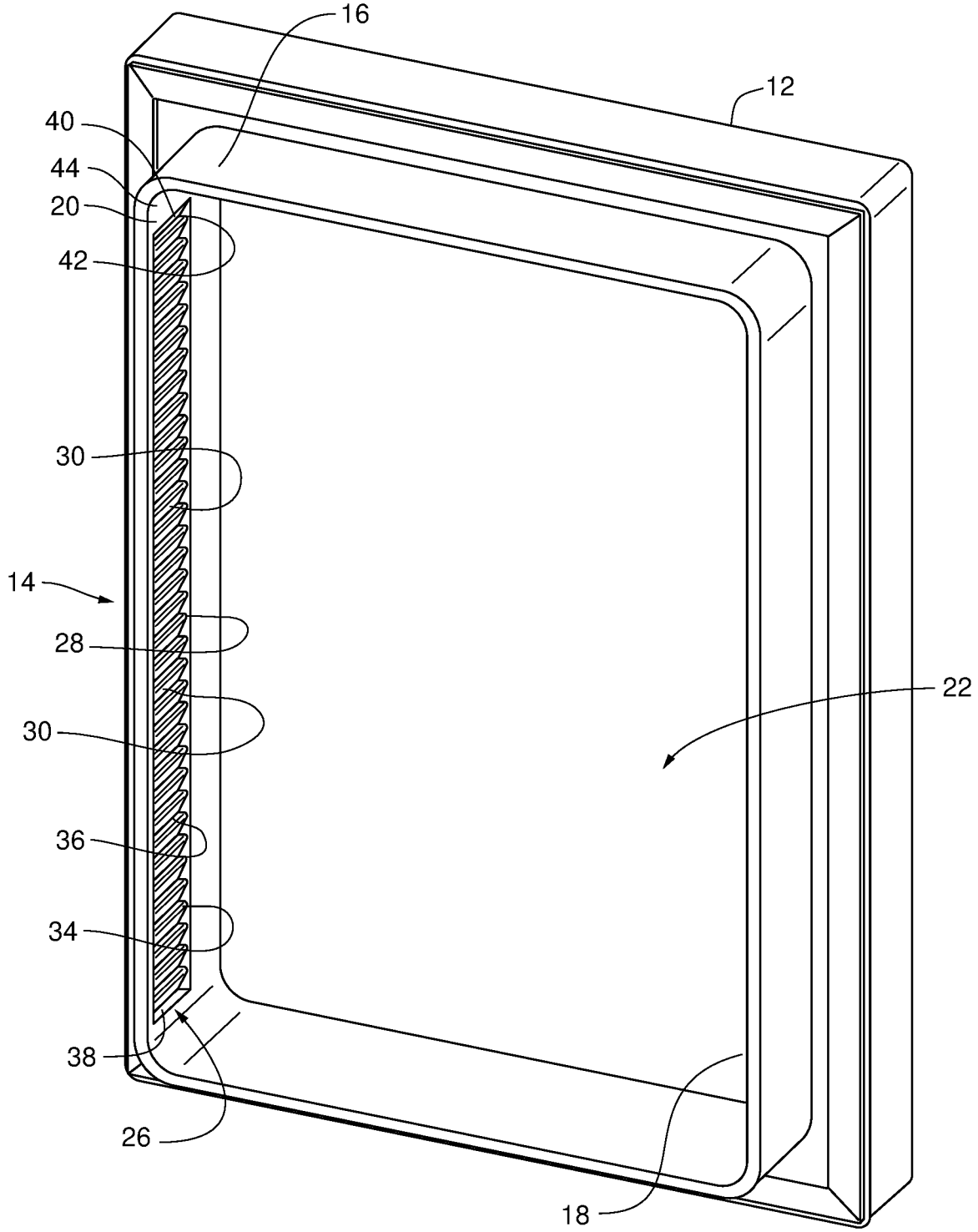
FIGS. 5 and 6, are close-up, opposing, front perspective views of a refrigerator door showing uninterrupted rows of ditch steps on the opposing side walls of the door.
Figure 6:
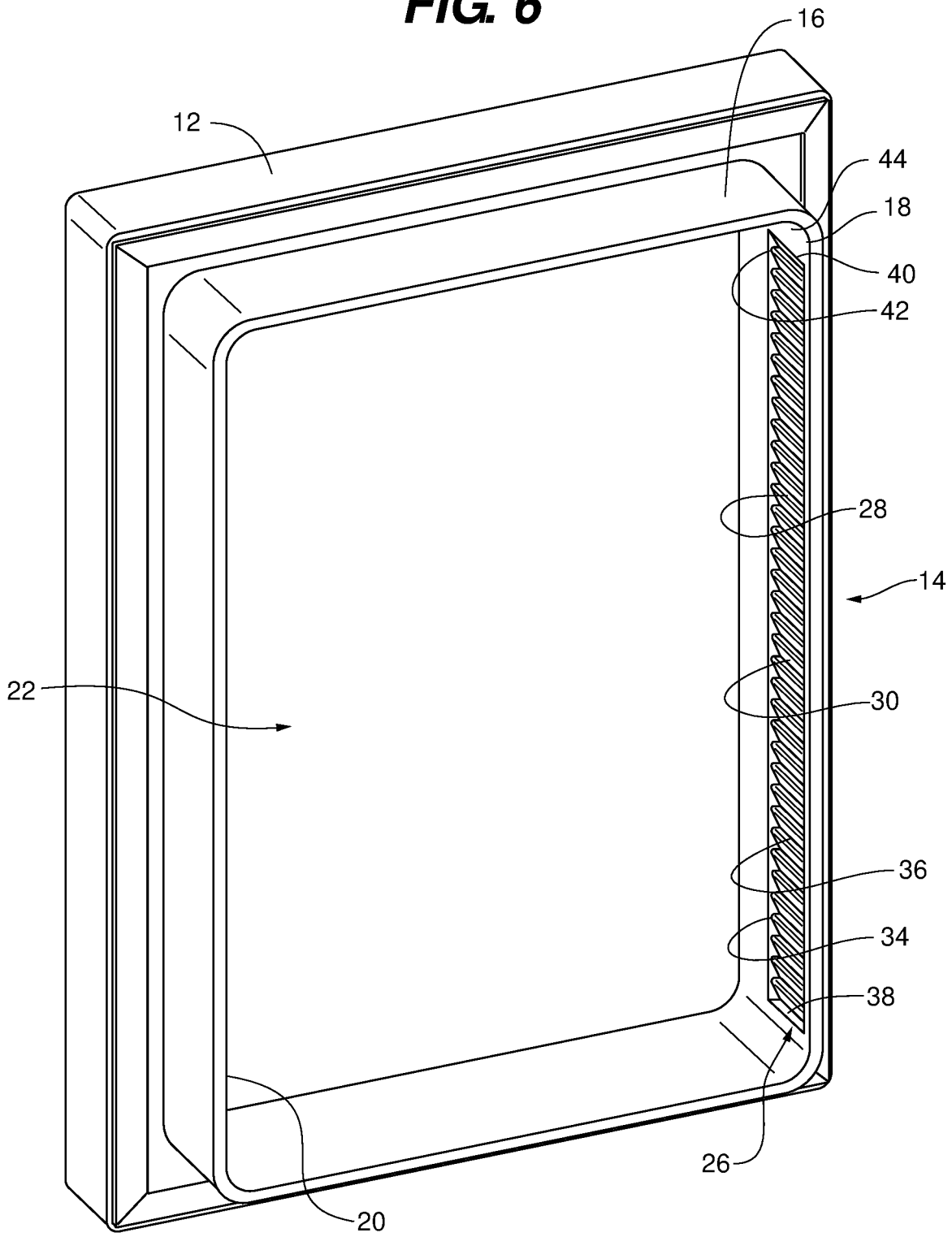

As shown in FIGS. 4-6 each row 26 is comprised of a plurality of uniformly sized and vertically spaced apart ditch steps 28. Each ditch step 28 is a horizontal platform separated by a tapered riser 30. As shown in FIGS. 1 and 3-4 the rows 26 may be segmented into discrete regions 32 of ditch steps 28, or may be a single uninterrupted row such as shown in the embodiment depicted in FIGS. 2 and 5-6.

Figure 12:
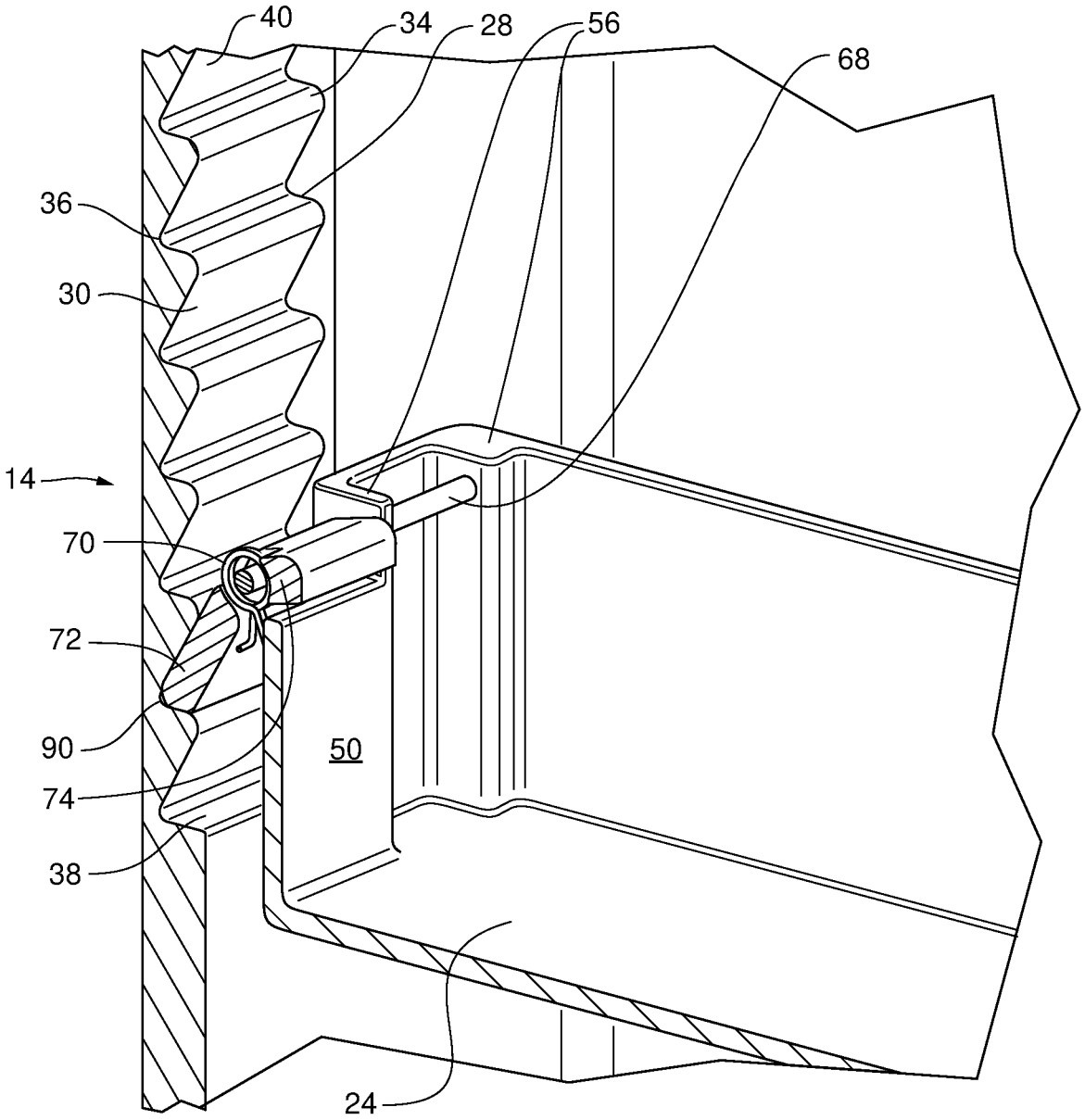
FIGS. 12 and 13 are detailed, sectional, perspective views of a switch, shelf and door shown in FIGS. 5-9.
Figure 13:
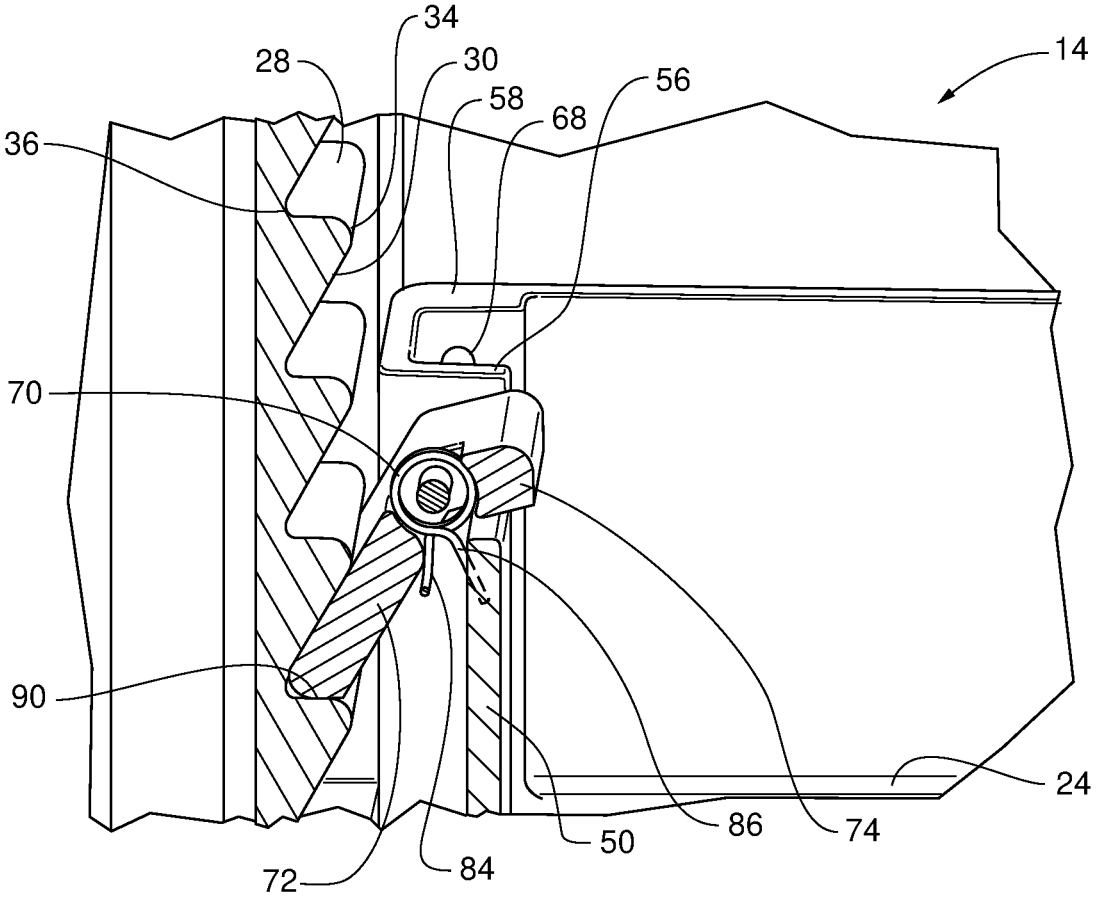
Figure 14:
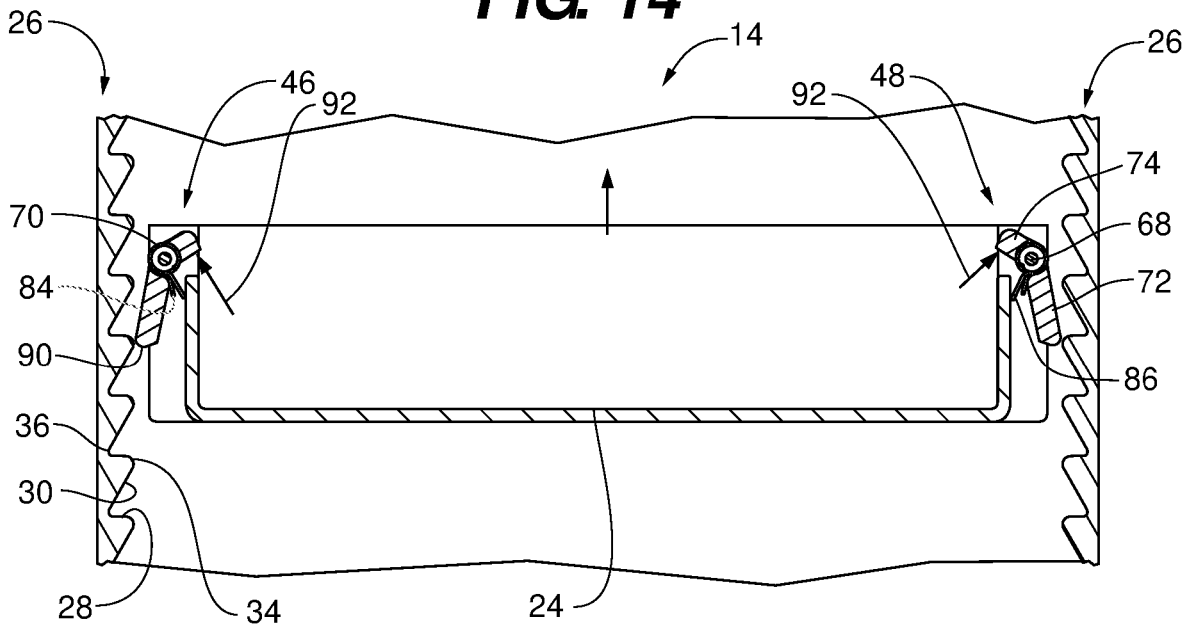
FIGS. 14 and 15 are front, close-up, sectional views of a portion of a refrigerator door incorporating the adjustable refrigerator shelving system and illustrating the manner in which a shelf is adjusted in an upward vertical direction relative to the opposing rows of ditch steps.
Figure 15:
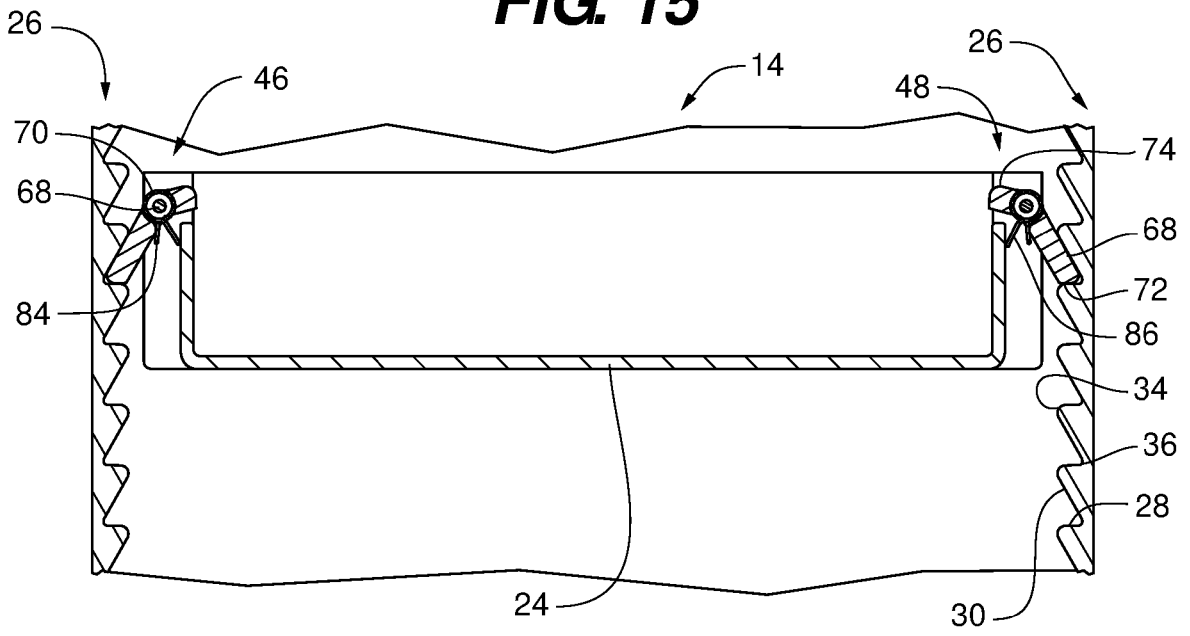
Figure 16:
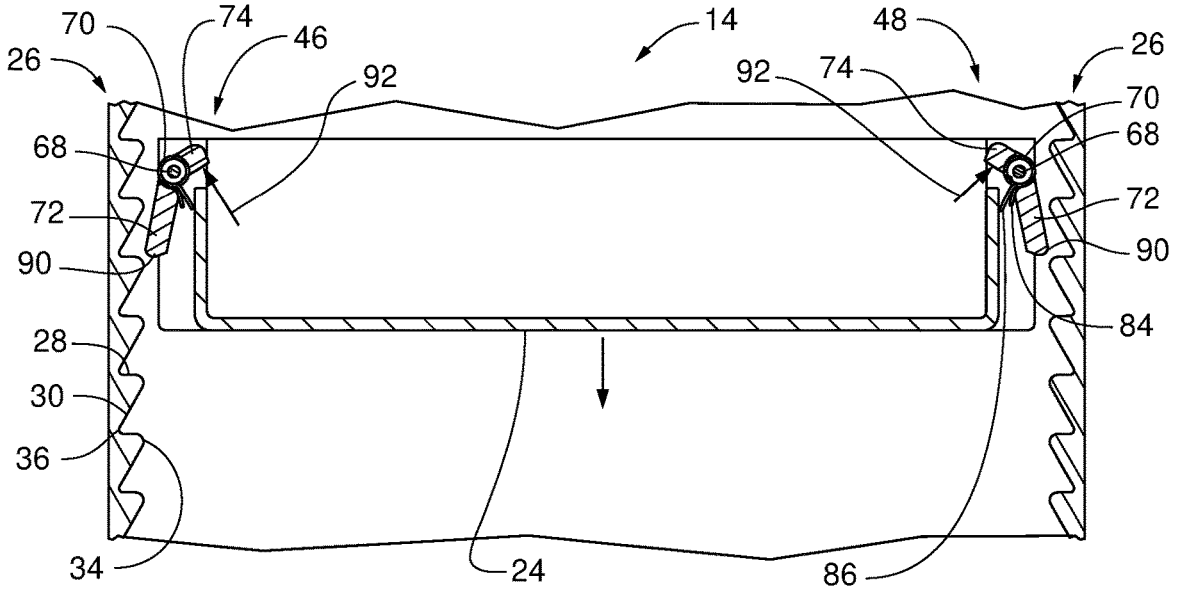
FIGS. 16 and 17 show the same view as in FIGS. 14 and 15, and illustrate the manner in which a shelf is adjusted in an downward vertical direction relative to the opposing rows of ditch steps.
Figure 17:
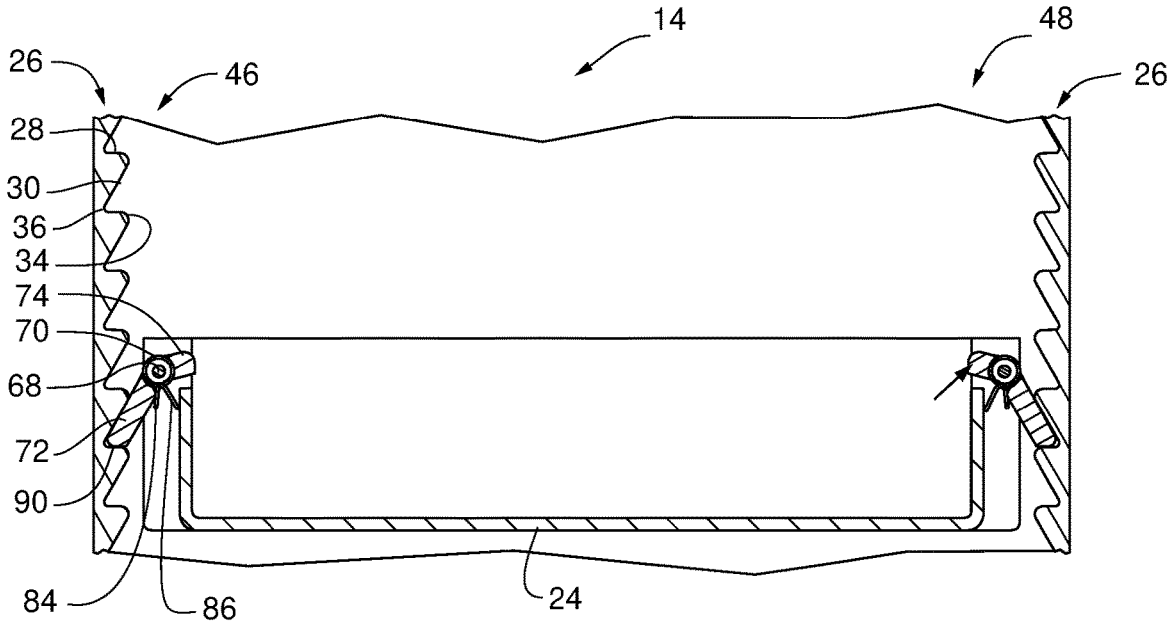

As best shown in FIGS. 12 and 13. Each ditch step 28 of a given row 26 or region 32 has a front (nosing) 34 and a back 36. The lowest vertically positioned ditch step in a row 26 or region 32 is a first or base ditch step 38. The tapered riser 30 extends from the back 36 of the first ditch step 38 to the front 34 of the next vertically higher ditch step 28 in a repeating riser 30 to ditch step 28 pattern.

In at least one embodiment, each row 26 or region 32 terminates at the vertically highest point of the row 26 or regions 32 at a terminal riser 40 that extends from the back 30 of a top most ditch step 42 to the adjacent interior surface 44 of the side wall 18 or 20.

Figure 7:
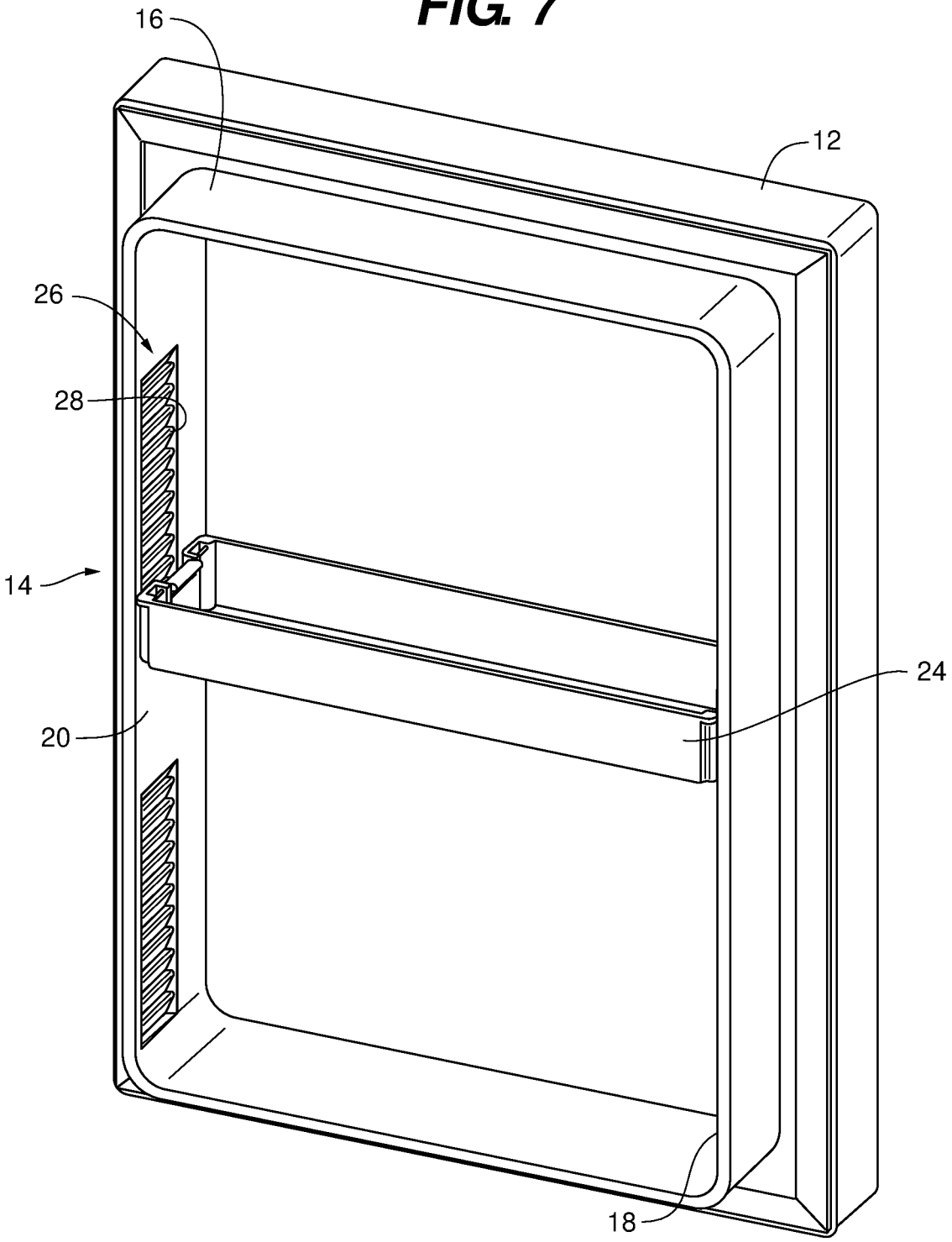
FIGS. 7 and 8 are the same views of the refrigerator door shown in FIGS. 3 and 4, with a shelf positioned between one set of the opposing rows of ditch steps.
Figure 8:
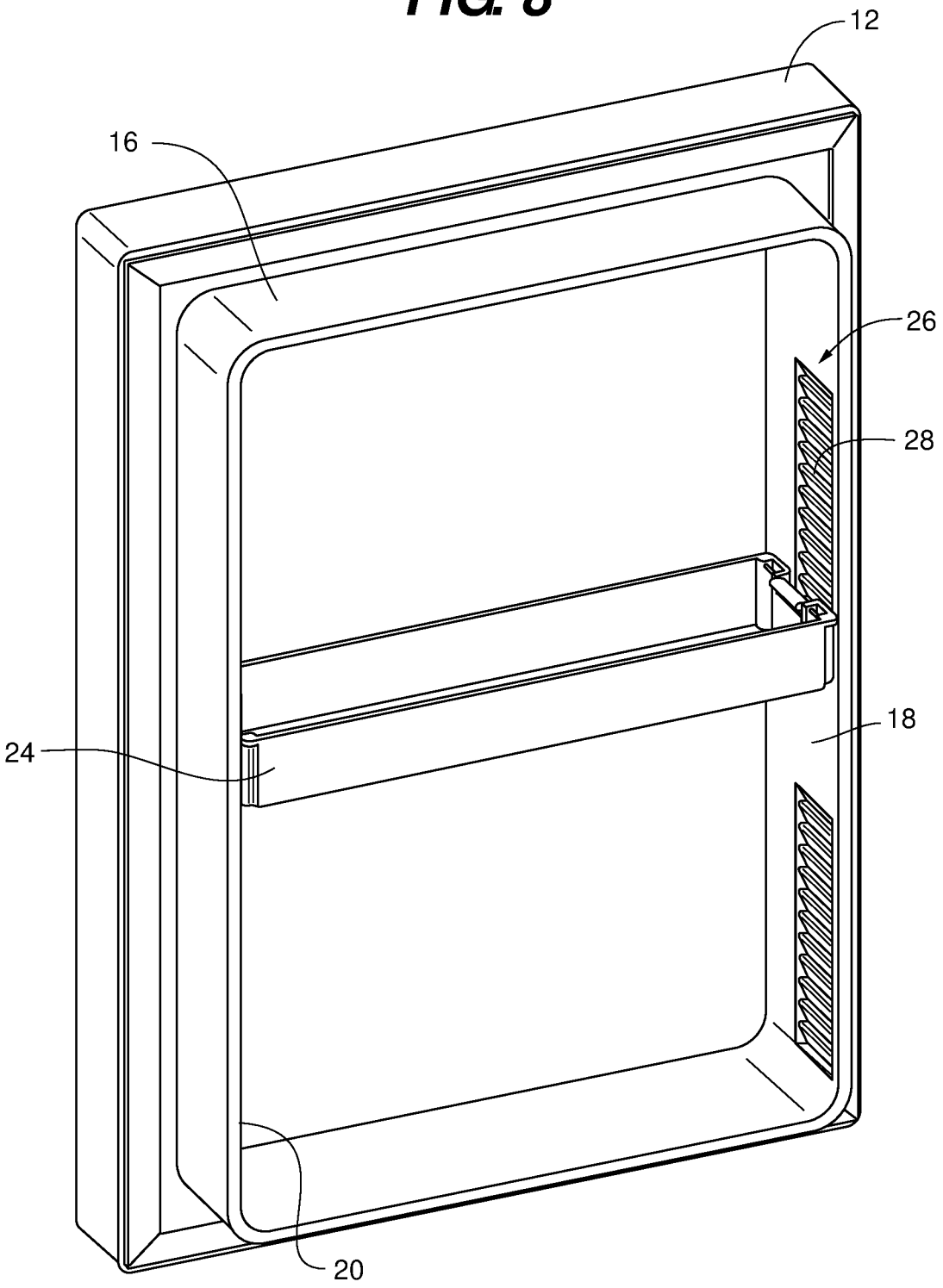
Figure 9:
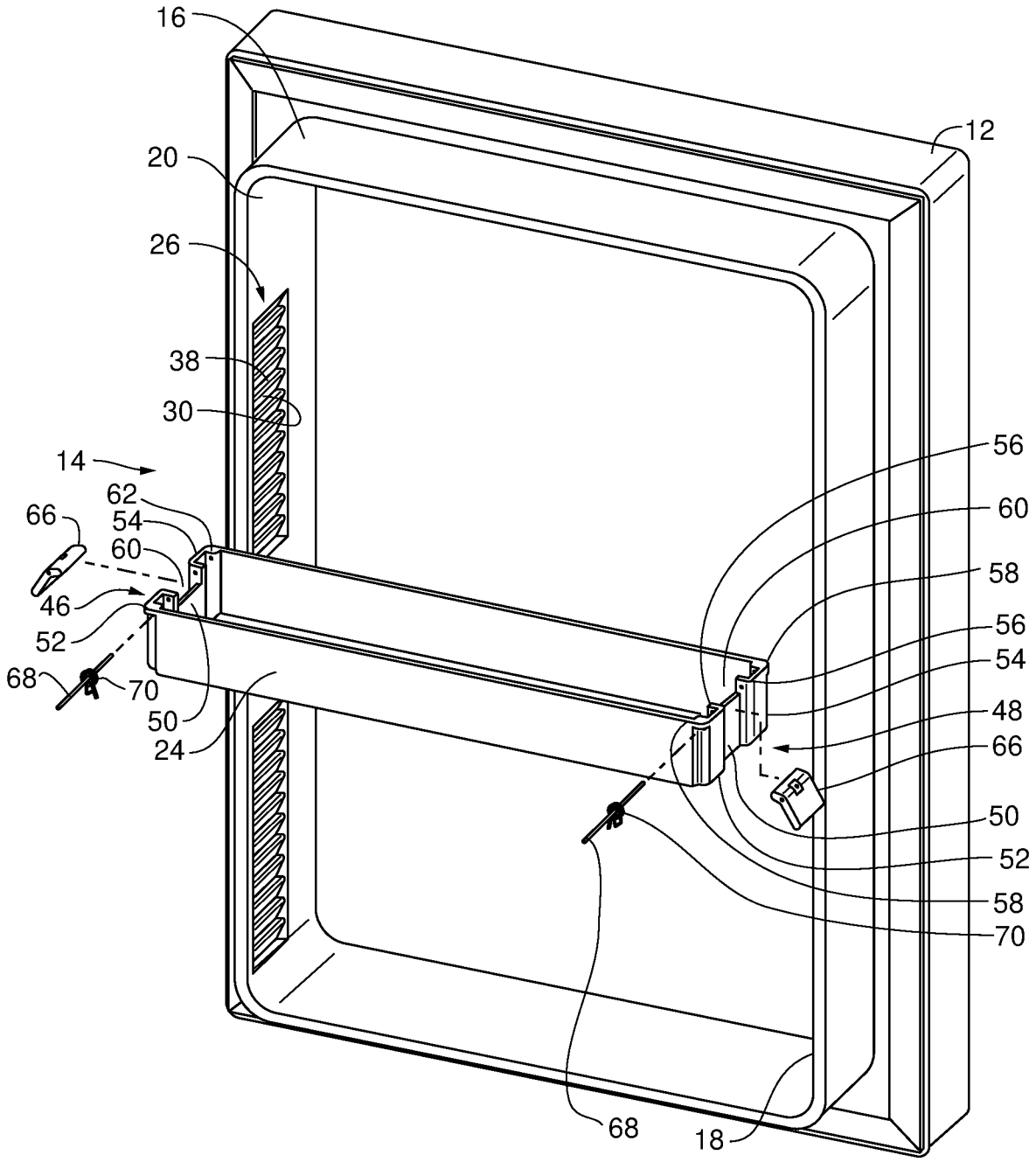
FIG. 9 is an exploded view of the shelf and door shown in FIGS. 7 and 8.

The rows 26 of ditch steps 28 defined by the opposing side walls 18 and 20 are spaced apart to receive and retain one or more shelves therebetween, such as the shelf 24 shown in FIGS. 7-9. As is best shown in FIG. 9, shelf 24 has a first end 46 and a second end 48. Each end 46 and 48 includes an indent or gap wall 50. The gap wall 50 is positioned between a first protrusion 52 and a second protrusion 54. Each protrusion 52 and 54 comprises a first pillar 56 and a second pillar 58. Each protrusion 52 and 54 has a height greater than the gap wall 50. The area above the gap wall 50 and between the protrusions 52 and 54 forms a switch pocket 60. Each pillar 56 and 58 defines a hole 62.

Figure 10:
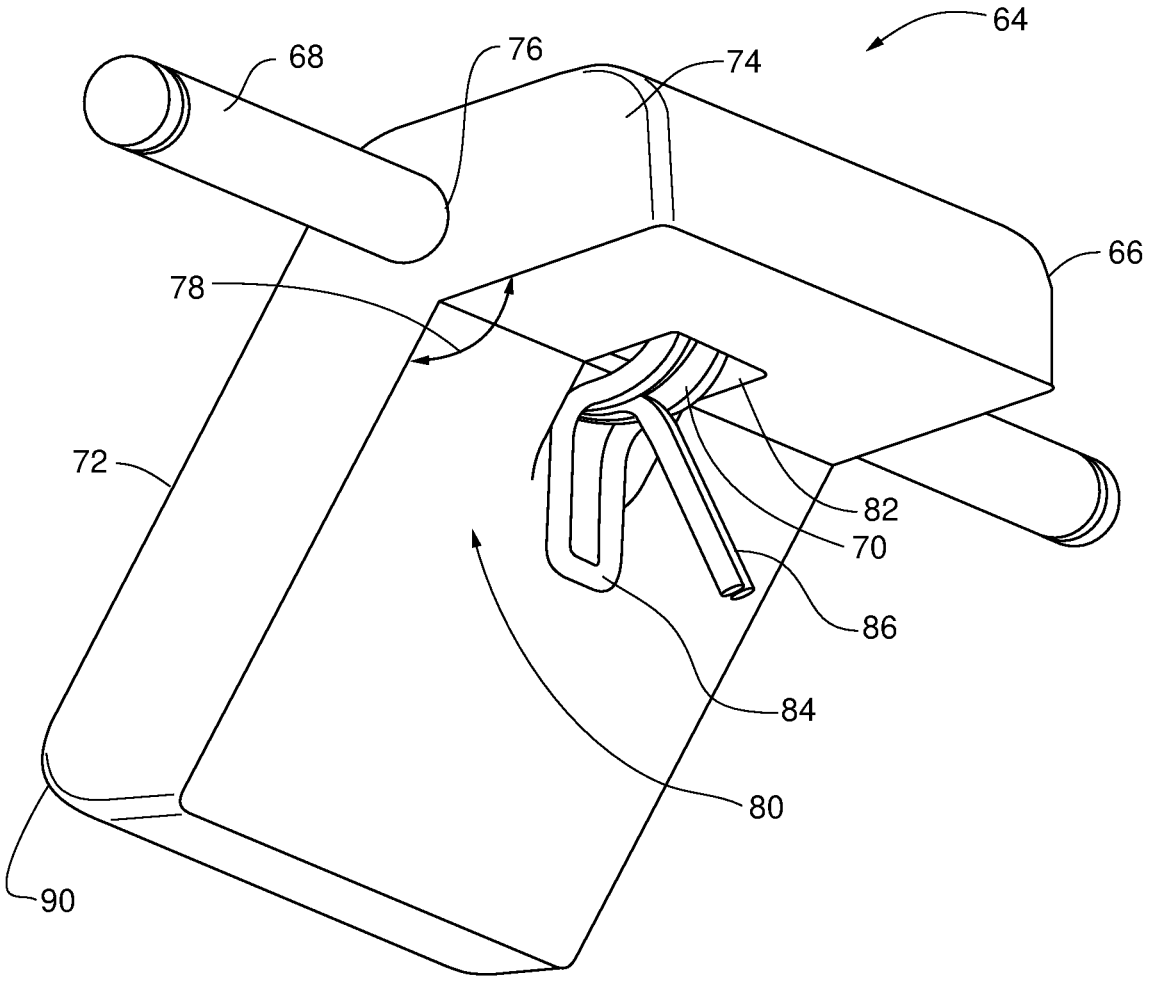
FIG. 10 is a close-up perspective view of a switch such as that used in the door and shelf shown in FIGS. 7-9.

Turning to FIG. 10, here, a shelf adjustment switch 64 is shown. Each shelf 24 (shown in FIG. 9) will have an adjustment switch 64 mounted at each end 46 and 48. Each adjustment switch 64 includes a switch handle 66 that is pivotable about a mounting rod 68. Positioned beneath the handle 66 and engaged to the mounting rod 68 is a biasing member 70.

The switch handle 66 is characterized by two major components: a long component 72 and a short component 74. The long component 72 is longer than the short component 74. At the intersection of the long component 72 and the short component 74 the switch handle 66 defines a mounting rod passage 76 that the mounting rod 68 may be passed therethrough. The long component 72 and the short component 74 define an obtuse angle 78. On the underside 80 of the switch handle 66, the long component 72 and the short component 74 define a biasing member notch 82 in communication with the mounting rod passage 76. The biasing member 70 is disposed about the mounting rod 68 and includes a first post 84 that extends out of the notch 82 to contact the underside 80 of the long component 72. A second post 86 of the biasing member 70 extends out of the notch 82 to contact the gap wall 50 when the switch 64 is properly engaged to the shelf 24, such as in the manner shown in FIG. 13.

Figure 11:
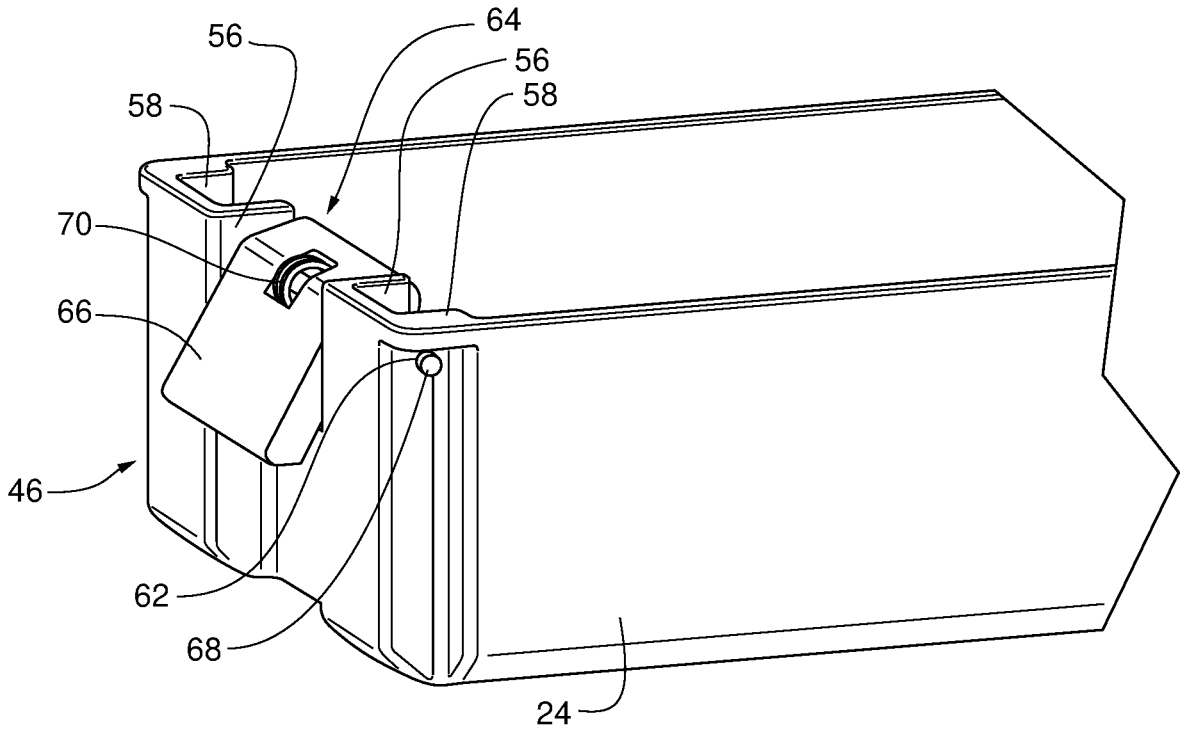
FIG. 11 is a partial external perspective view of an end of the shelf shown in FIGS. 7-9 to illustrate the position and outward bias of the switch shown in FIG. 8, relative to the shelf.

Returning to FIG. 9, it will be appreciated that each switch 64 is engaged to a respective end 46 and 48 of the shelf 24 by positioning the handle 66 and biasing member 70 within the switch pocket 60 (see FIG. 11 showing end 46 for illustration) and then inserting/threading the mounting rod 68 through the holes 62 of each pillar 56 and 58 of each protrusion 52 and 54.

Once each end 46 and 48 of the shelf 24 are equipped with an adjustment switch 64, the shelf 24 is ready for insertion into the door insert 16, such as in the manner shown in FIGS. 7-8.

Operation of the system 14, is best illustrated in FIGS. 12-17, with reference to the components of the adjustment switch 64 depicted in FIG. 10. As shown, when a shelf 24 is inserted into the interior 22 of the door liner 16, an engagement end 90 of each of long component 72 of the switch 64 rests upon a ditch step 28 of one of the opposing rows 26. When no other force is applied to the switch handle 66, the biasing member 70, via the first post 84 and second post 86 will force the long component 72 of the switch 64 outward and away from the gap wall 50 such as in the manner shown in FIGS. 12, 13, 15 and 17.

The short component 74 of each switch handle 66 is a user interface which may be manipulated to pivot the long component 74 of the switch handle 66 toward the gap wall 50. When manipulated in this manner, the user applies a force sufficient to overcome the biasing force supplied by biasing member 70 that holds the engagement end 90 against the ditch step 28. By actuating both switches 64 of a shelf 24, such as in the manner shown in FIGS. 14 and 16 (see arrows 92, the shelf 24 may be moved in a vertically upward direction (see FIGS. 14-15), or in a vertically downward direction (see FIGS. 16-17). Once the shelf 24 is in the proper position between the opposing rows 26 of ditch steps 28, each switch handle 66 is released allowing the engagement end 90 to once again secured against the desired ditch step 28.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A shelving system for a refrigerator door comprises:

a door liner, the door liner having opposing side walls, wherein each sidewall defines a row of ditch steps;

at least one shelf, the at least on shelf having a first end and a second end, each end having a gap wall, a switch is positioned above each gap wall, each switch comprises:

a switch handle, a mounting rod and a biasing member, the switch handle having a long component and a short component, the long component defining a ditch step engagement end, the long component having a length greater than the short component, at an intersection of the long component and the short component the switch handle defining a mounting rod passage, the switch handle having an interior surface and defining a notch, the notch being in communication with the mounting rod passage, the mounting rod configured to extend through the mounting rod passage, the switch handle being pivotable about the mounting rod, the biasing member configured to be positioned within the notch and disposed about the mounting rod, the biasing member includes a first biasing post that extends through the notch to contact the interior surface of the long component and a second biasing post that extends through the notch to contact the gap wall, the biasing member biasing the long component of the switch handle outwardly away from the gap wall;

the at least one shelf being removeably positionable between the opposing sidewalls, such that when the at least one shelf is positioned in place between the sidewalls, each ditch step engagement end is engaged to one of the ditch steps.

2. The system of claim 1, wherein each row of ditch steps is comprised of a plurality of ditch steps extending vertically upward from a base ditch step, each ditch step has a back and a front, each ditch step being separated by a tapered riser, the tapered riser extending from the back of the base ditch step to the front of a next vertically adjacent ditch step in the row.

3. The system of claim 2, wherein each row of ditch steps terminates at terminal riser.

4. The system of claim 3, wherein each side wall defines an interior surface, each row of ditch steps is segmented into plurality of regions of ditch steps separated by the interior surface of the side wall.

5. The system of claim 1, wherein the gap wall is positioned between a first protrusion and a second protrusion, each protrusion comprises a first pillar and a second pillar, each protrusion has a height greater than the gap wall and defining a switch pocket above the gap wall and between the first protrusion and the second protrusion, the switch handle constructed and arranged to fit within the switch pocket.

6. The system of claim 5, wherein each pillar defines a hole, the mounting rod being configured for passage through the hole of each pillar to secure the switch thereto.

7. A shelf for use with a refrigerator having a door liner with opposing sidewalls, each sidewall having a row of ditch steps, the shelf comprises:

a first end and a second end, each end having a gap wall, a switch is positioned above each gap wall, each switch comprises:

a switch handle, a mounting rod and a biasing member, the switch handle having a long component and a short component, the long component defining a ditch step engagement end, the long component having a length greater than the short component, at an intersection of the long component and the short component the switch handle defining a mounting rod passage, the switch handle having an interior surface and defining a notch, the notch being in communication with the mounting rod passage, the mounting rod configured to extend through the mounting rod passage, the switch handle being pivotable about the mounting rod, the biasing member configured to be positioned within the notch and disposed about the mounting rod, the biasing member includes a first biasing post that extends through the notch to contact the interior surface of the long component and a second biasing post that extends through the notch to contact the gap wall, the biasing member biasing the long component of the switch handle outwardly away from the gap wall;

the shelf being removeably positionable between the opposing sidewalls, such that when the shelf is positioned in place between the sidewalls, each ditch step engagement end is engaged to one of the ditch steps.

8. The shelf of claim 7, wherein the gap wall is positioned between a first protrusion and a second protrusion, each protrusion comprises a first pillar and a second pillar, each protrusion has a height greater than the gap wall and defining a switch pocket above the gap wall and between the first protrusion and the second protrusion, the switch handle constructed and arranged to fit within the switch pocket.

9. The system of claim 8, wherein each pillar defines a hole, the mounting rod being configured for passage through the hole of each pillar to secure the switch thereto.

* * * * *